US009279631B2

(12) United States Patent
Barnhart

(10) Patent No.: US 9,279,631 B2
(45) Date of Patent: Mar. 8, 2016

(54) HIGH CAPACITY MAGAZINE EFFICIENT LOADER DEVICE AND RELATED METHOD

(71) Applicant: Craig M. Barnhart, Gretna, NE (US)

(72) Inventor: Craig M. Barnhart, Gretna, NE (US)

( * ) Notice: Subject to any disclaimer, the term of this patent is extended or adjusted under 35 U.S.C. 154(b) by 201 days.

(21) Appl. No.: 14/089,087

(22) Filed: Nov. 25, 2013

(65) Prior Publication Data

US 2014/0373416 A1 Dec. 25, 2014

Related U.S. Application Data

(60) Provisional application No. 61/731,827, filed on Nov. 30, 2012.

(51) Int. Cl.
*F41A 9/61* (2006.01)
*F41A 9/67* (2006.01)

(52) U.S. Cl.
CPC ..... *F41A 9/67* (2013.01)

(58) Field of Classification Search
USPC ..... 42/87, 50, 49.01, 49.1; 89/33.1
See application file for complete search history.

(56) References Cited

U.S. PATENT DOCUMENTS

| | | | | |
|---|---|---|---|---|
| 5,291,679 | A * | 3/1994 | Wollack et al. | 42/50 |
| 5,402,594 | A * | 4/1995 | Switzer | 42/90 |
| 5,417,003 | A * | 5/1995 | Claveau | 42/90 |
| 6,807,764 | B1 * | 10/2004 | Phillips | 42/87 |

* cited by examiner

*Primary Examiner* — J. Woodrow Eldred
(74) *Attorney, Agent, or Firm* — Suiter Swantz pc llo

(57) ABSTRACT

A device and related method are disclosed for efficient loading of a spring powered magazine. The magazine body is configured with equal and opposite lateral channels extending from the magazine floor to near the magazine top. The channels are located approximately at a longitudinal midpoint of the magazine body. The follower of the magazine is configured with a follower sleeve having a longitudinal dimension approximately equal to the longitudinal dimension of the opposite lateral channels and aligned with the opposite lateral channels as the follower slidably travels along a vertical axis of the magazine body. As the follower sleeve aligns with the opposite lateral channels, it is configured to be engaged by a compression tool to relieve, as the compression tool acts upon the follower, spring tension between the latest round loaded and the retainer lips of the magazine opening.

15 Claims, 8 Drawing Sheets

HIGH CAPACITY MAGAZINE EFFICIENT LOADER DEVICE AND RELATED METHOD

CROSS-REFERENCE TO RELATED APPLICATIONS

The present application claims the benefit under 35 U.S.C. §119(e) of U.S. Provisional Application 61/731,827 filed Nov. 30, 2012 entitled "High Capacity Magazine Efficient Loader Device and Related Method" which is hereby incorporated by reference in its entirety.

FIELD OF THE INVENTION

The present invention relates generally to ammunition magazine construction. More particularly, embodiments of the present invention relate to an efficient device and method for assisting a person in loading high capacity magazines with multiple rounds of ammunition.

BACKGROUND OF THE INVENTION

Traditional high capacity staggered column magazines may be difficult for a person to fill and reload. Especially difficult are magazines capable of holding 15 or more rounds of ammunition. Substantial finger pressure is required and may cause injury or damage to the thumb of the person loading the staggered column magazine.

Prior art methods of assisting a person in loading a magazine may be cumbersome or require a sizable loading assistance device to operate. These devices may act on the last loaded round compressing the spring sufficiently to load another round more easily than would be the case if the last round was not depressed. These pushing methods may 1) damage a round on which the pushing method acts, 2) require a large form factor device external to the magazine to operate, 3) require the presence of the device to operate, and 4) be ultimately less useful if relied upon for continuous use.

Therefore, a need exists for a high capacity magazine loading assistance device and method which requires a minimum of tools external to the magazine.

SUMMARY

Accordingly, an embodiment of the present invention is directed to a device for efficient loading of a spring powered magazine, comprising: a magazine, the magazine for receiving and storing a plurality of rounds of ammunition, the magazine having a magazine body, the magazine body having a floor and a top opposite the floor; a floor plate removably attached to the magazine floor, the floor plate for securing the floor of the magazine; a spring within the magazine body for applying spring tension vertically from the floor plate, the floor plate removably coupled to a floor end of the spring; a follower within the magazine, the follower for slidably transferring the spring tension from the spring to the plurality of rounds of ammunition, the follower removably coupled to a top end of the spring, the floor plate removably coupled to a bottom end of the spring; the magazine body configured with opposite lateral channels, the opposite lateral channels of equal dimension and having a bottom end proximal to the magazine floor and a top end distal from the magazine floor; the opposite lateral channels having a maximum longitudinal dimension of approximately 0.15 of a magazine body longitudinal dimension, the opposite lateral channels having a minimum vertical dimension of approximately 0.6 of a magazine body vertical dimension, the opposite lateral channels located approximately at a longitudinal midpoint of the magazine body; the follower having a follower sleeve, the follower sleeve having a longitudinal dimension approximately equal to the longitudinal dimension of the opposite lateral channels, the follower sleeve aligned with the opposite lateral channels as the follower slidably travels along a vertical axis of the magazine body; wherein the follower sleeve is configured to be removably engaged by a compression tool, the follower sleeve further configured to relieve, as the compression tool acts upon the follower, spring tension away from the plurality of rounds of ammunition.

An additional embodiment of the present invention is directed to a device wherein the bottom ends of the opposite lateral channels are proximal to the floor of the magazine body and the top ends of the opposite lateral channels are positioned so the follower sleeve is visible after approximately seven rounds of ammunition are loaded in the magazine body.

An additional embodiment of the present invention is directed to a device wherein the follower sleeve is cylindrical with a diameter approximately equal to the longitudinal dimension of the opposite lateral channels, the compression tool configured as a rod of a diameter slightly smaller than the diameter of the follower sleeve.

An additional embodiment of the present invention is directed to a device wherein the follower sleeve diameter is approximately equal to the longitudinal dimension of the opposite lateral channels and is approximately 0.1 inches in diameter.

An additional embodiment of the present invention is directed to a device wherein the follower is further configured with a permanently affixed compression tool, the permanently affixed compression tool extends laterally from the opposite lateral channels a distance allowing the magazine to be inserted into a weapon housing, and wherein the top end of the opposite lateral channels extends vertically proximal to the top of the magazine body.

An additional embodiment of the present invention is directed to a device wherein the magazine body is configured with opposite longitudinal channels, the opposite longitudinal channels configured on longitudinal sides of the magazine body, the follower sleeve configured longitudinally through follower and aligned with the opposite longitudinal channels.

An additional embodiment of the present invention is directed to a device wherein the compression tool is permanently coupled to the follower, the coupled compression tool further configured to laterally compress to a dimension equal to an internal dimension of the magazine body, the coupled compression tool further configured to laterally extend to a lateral dimension greater than an external dimension of the magazine body.

An additional embodiment of the present invention is directed to a method for efficient loading of a spring powered magazine, comprising: configuring a magazine body with opposite lateral channels, the magazine body one element of a magazine for receiving and storing a plurality of rounds of ammunition, the magazine having a floor and a top opposite the floor, the opposite lateral channels of equal dimension and having a bottom end proximal to the magazine floor and a top end distal from the magazine floor; the opposite lateral channels having a maximum longitudinal dimension of approximately 0.15 of a magazine body longitudinal dimension, the opposite lateral channels having a minimum vertical dimension of approximately 0.6 of a magazine body vertical dimension, the opposite lateral channels located approximately at a longitudinal midpoint of the magazine body; configuring a follower with a follower sleeve, the follower one element of the magazine and within the magazine body, the follower for slidably transferring a spring tension from a spring to the plurality of rounds of ammunition, the follower removably coupled to a top end of the spring, the follower sleeve having a longitudinal dimension approximately equal to the longitudinal dimension of the opposite lateral channels, the follower sleeve aligned with the opposite lateral channels as the follower slidably travels along a vertical axis of the magazine body; removably coupling the spring within the magazine body to a floor plate on a floor end of the spring and to the follower on a top end of the spring for applying spring tension vertically from the spring; aligning the opposite lateral channels with the follower sleeve, the aligning for inserting a compression tool through the opposite lateral channels and the follower sleeve to relieve, as the compression tool acts upon the follower, the spring tension away from the plurality of rounds of ammunition.

An additional embodiment of the present invention is directed to a method for efficient loading of a spring powered magazine, comprising: means for reducing a vertical upward spring tension exerted by a follower on a first and second round of ammunition loaded within a magazine, the vertical upward spring tension reduced without contact with a latest round of ammunition loaded in the magazine; means for reducing a spring tension between a latest round of ammunition loaded in a magazine and a retainer lip of the magazine, the spring tension reduced without contact with the latest round of ammunition loaded in the magazine; and means for increasing the a spring compression within a magazine, the compression increased without contact with the latest round of ammunition loaded in the magazine; wherein each of the reducing means and the increasing means do not require an insertion means into an open end of the magazine.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

The following description presents certain specific embodiments of the present invention. However, the present invention may be embodied in a multitude of different ways as defined and covered by the claims. In this description, reference is made to the drawings wherein like parts are designated with like numerals throughout.

One goal of the present invention may include a device and method requiring a small rod compression tool of variable size external to a magazine body configured to remove a portion of spring tension and assist a person loading the magazine.

An additional goal of the present invention may include a loading assistance device and method requiring only a small compression tool rod to operate.

An additional goal of the present invention may include a self-contained follower capable of 1) positioning a round for chamber entry (normal operations) when loaded into a weapon as well as 2) allowing, when unloaded a user to remove a portion of spring tension to enable efficient loading of a round of ammunition into the magazine body.

An additional goal of the present invention may include providing a magazine configured with oppositely aligned lateral channels, the opposite lateral channels also aligned with a sleeve in a follower mechanism internal to magazine body. The opposite lateral channels aligned with the follower sleeve configured for threading a small compression tool through the magazine walls and follower. The compression tool capable of manual compression of a spring within the magazine positioning the follower in a position for a person to more easily insert a round of ammunition in the magazine than would be the case if the spring were not compressed.

Figure 1:
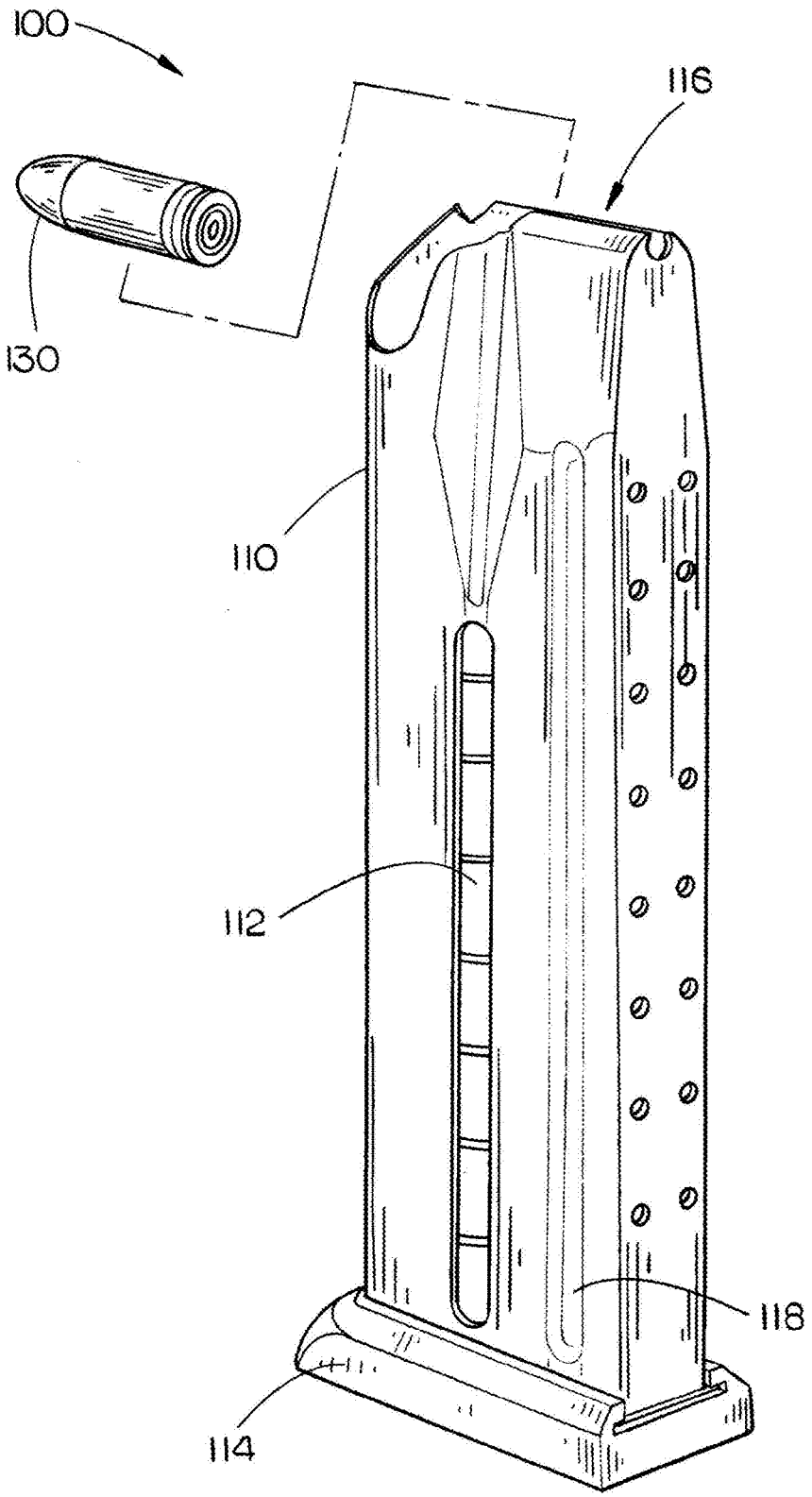
FIG. 1 is a perspective view of a high capacity magazine representative of a preferred embodiment of the present invention.
Figure 3:
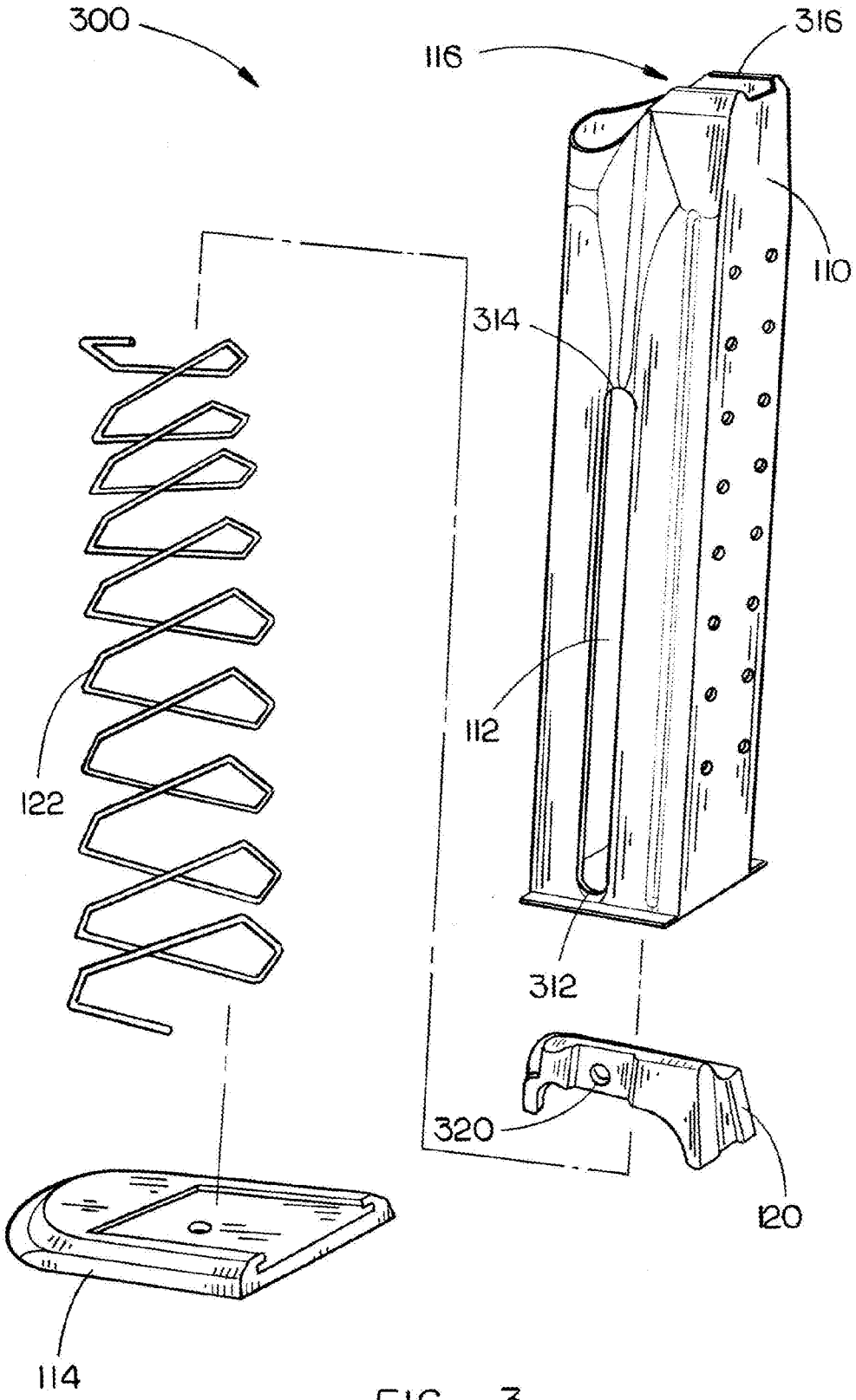
FIG. 3 is an exploded view of a preferred embodiment of the present invention.

Referring to FIG. 1, a perspective view of a high capacity magazine representative of a preferred embodiment of the present invention is shown. A magazine 100 of the present invention is configured for receiving and storing a plurality of rounds of ammunition 130. The magazine 100 having a magazine body 110 including a magazine floor and a magazine top 116 opposite the floor. The magazine 100 may include opposite lateral channels 112 in the side walls of the magazine body 110. Magazine 100 may include a floor plate 114 removably attached to the floor of the magazine body 110. In addition to securing the floor of the magazine 110, floor plate 114 may act against the magazine spring 122 (FIG. 3). Magazine top 116 is configured with magazine retainer lips 316 through which the plurality of rounds of ammunition 130 may pass in two directions; a first direction to load the magazine with rounds of ammunition 130 and a second direction for rounds of ammunition 130 to leave the magazine 100 and enter a weapon (not pictured). Guide 118 may align magazine 100 for appropriate insertion into the weapon.

Skilled artisans will recognize the magazine body 110 may be constructed of material of sufficient strength to maintain the integrity of the body yet of sufficiently light weight to remain a viable weighted element of the overall weapon. With opposite lateral channels 112 constructed within the side walls of magazine body 110, structural integrity of the magazine body 110 may become an issue. Therefore, embodiments of the present invention may reinforce certain portions of the magazine body 110 to maintain structural integrity of the magazine body 110 with the associated lateral forces thereupon when rounds of ammunition 130 are fully loaded within.

Figure 2:
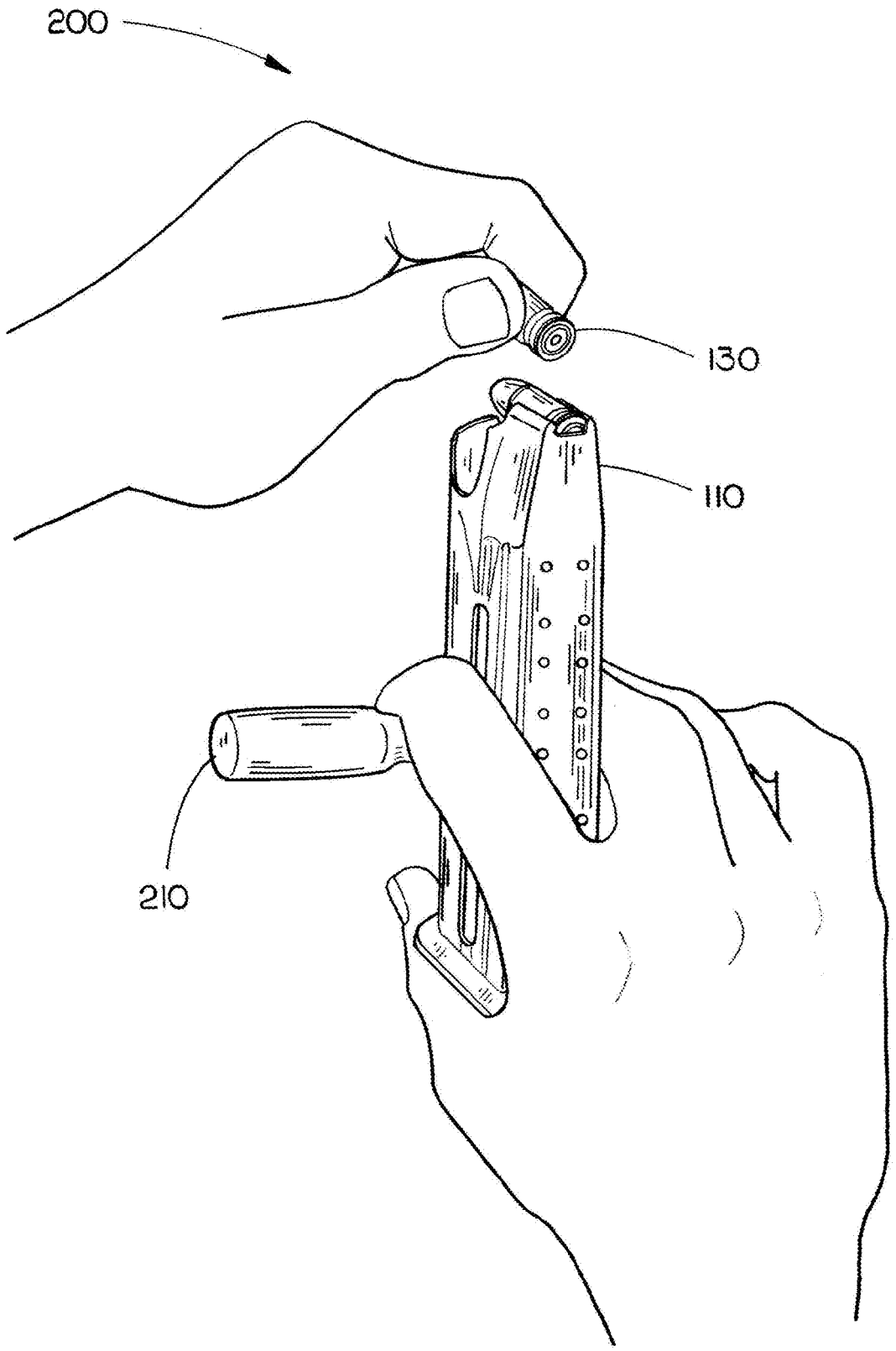
FIG. 2 is a perspective view of a high capacity magazine loadable via one embodiment of the present invention.

Referring to FIG. 2, a perspective view of a high capacity magazine loadable via one embodiment of the present invention is shown. A user of device 200 may employ finger pressure on compression tool 210 to remove a portion of the spring tension exerted within the magazine body 110. With a thumb on the floor plate and a finger on each side of the compression tool 210, a user may sufficiently compress the spring 122 (FIG. 3) to remove sufficient upward pressure on the rounds of ammunition 130 currently loaded to enable an additional round to be easily loaded. In one embodiment, compression tool 210 may comprise a rod inserted through aligned opposite lateral channels 112 to act on components internal to magazine body 110 to remove a portion of the spring tension.

As the user presses the compression tool 210 (exemplary here a small screwdriver) away from the magazine top 116 of the magazine 100, the internal spring 122 is compressed reducing upward tension between the magazine retainer lips 316 at the magazine top 116 of the magazine body and the latest round loaded currently in the magazine 100. This tension reduction on the latest round loaded may allow the user to more easily load the next round 130.

Referring to FIG. 3, an exploded view of a preferred embodiment of the present invention is shown. With the floor plate 114 removed, the individual elements of the magazine 100 may be shown. Floor plate 114 may retain each element of the magazine 300 in place when assembled. Spring 122 provides tension on follower 120 to ensure each round of ammunition 130 is in position to be fed into the weapon chamber as the round reaches the first position. Follower 120 provides proper positioning and angle of each round as the round is in the first position. Follower sleeve 320 may be comprised of a cylindrical orifice or other sleeve aligned laterally and extending through the entirety of follower 120. Follower sleeve 320 must be aligned with opposite lateral channels 112 as magazine 100 elements are reassembled. Magazine body 110 provides structure for each of the internal elements as well as a reservoir for loaded rounds of ammunition 130.

Preferably, the co-aligned opposite lateral channels 112 are of sufficient longitudinal dimension to receive a small compression tool 210 laterally inserted through the entirety of the device 300. A preferable, and approximately equal, size of each related element: 1) follower sleeve 320, 2) opposite lateral channels 112, and 3) compression tool 210 may be a size strong enough for compression tool 210 to overcome spring 122 tension without breaking compression tool 210, yet small enough for magazine body 110 and follower 120 to maintain sufficient strength for successful operation. Ideally, compression tool 210 may be small enough to flex a small amount while follower 120 is in a position proximal to floor plate 114 where spring tension is the maximum for spring 122.

Preferably opposite lateral channels 112 are of a height lesser than the height of the magazine body 110. Opposite lateral channels may have a top 314 and a base 312. The base 312 of opposite lateral channels 112 may preferably be proximal to the floor plate 114 while the top 314 of opposite lateral channels 112 may not be proximal to the top 116. Location of the top 314 of the opposite lateral channels 112 may be variable based on a variety of factors including, but not limited to: magazine body 110 construction materials, the caliber of round of ammunition for which the magazine is designed, the length of the rounds of ammunition 130, and a constant of the spring tension. For example, with greater spring tension, the top 314 of opposite lateral channels 112 may be closer to the magazine top 116 (an overall longer opposite lateral channel) enabling access to the follower sleeve 320 through opposite lateral channels 112 after only 2-3 rounds are loaded.

Figure 4A:
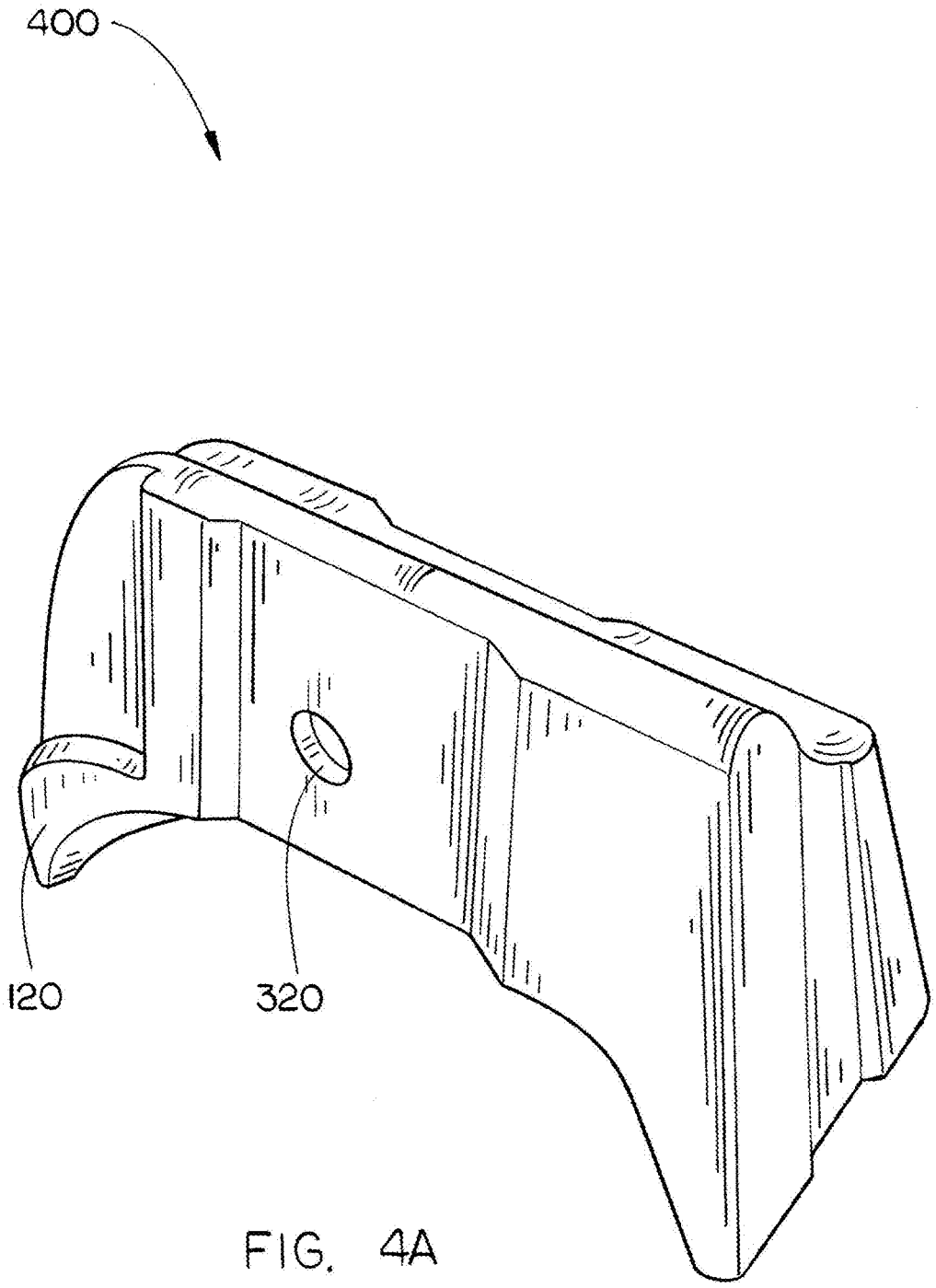
FIG. 4A is a perspective view of a follower illustrative of an embodiment of the present invention.

Referring to FIG. 4A, a perspective view of a follower illustrative of an embodiment of the present invention is shown. Follower 120 is one of the elements internal to magazine 300. In operation, follower 120 may slidably and internally traverse the vertical height of magazine body 110 to apply spring 122 tension on loaded rounds of ammunition 130. In the loading operation, follower 120 is acted upon and displace vertically toward the floor plate 114 as each round of ammunition is progressively loaded.

Follower sleeve 320 may function as the opening through which the compression tool 210 may be placed. As a user may put pressure on compression tool 210 in a direction toward the floor plate 114, the pressure is transmitted through contact with the follower sleeve 320. The follower 120 displaces away from the magazine top 116 allowing for less spring tension required by the user to overcome when loading the next round.

Skilled artisans may recognize follower 120 may preferably be constructed of high strength plastic or other well-known material. It is contemplated material of increased strength such as steel or aluminum may be used to either strengthen follower 120 around follower sleeve 320 or as an alternative material of complete construction.

Figure 4B:
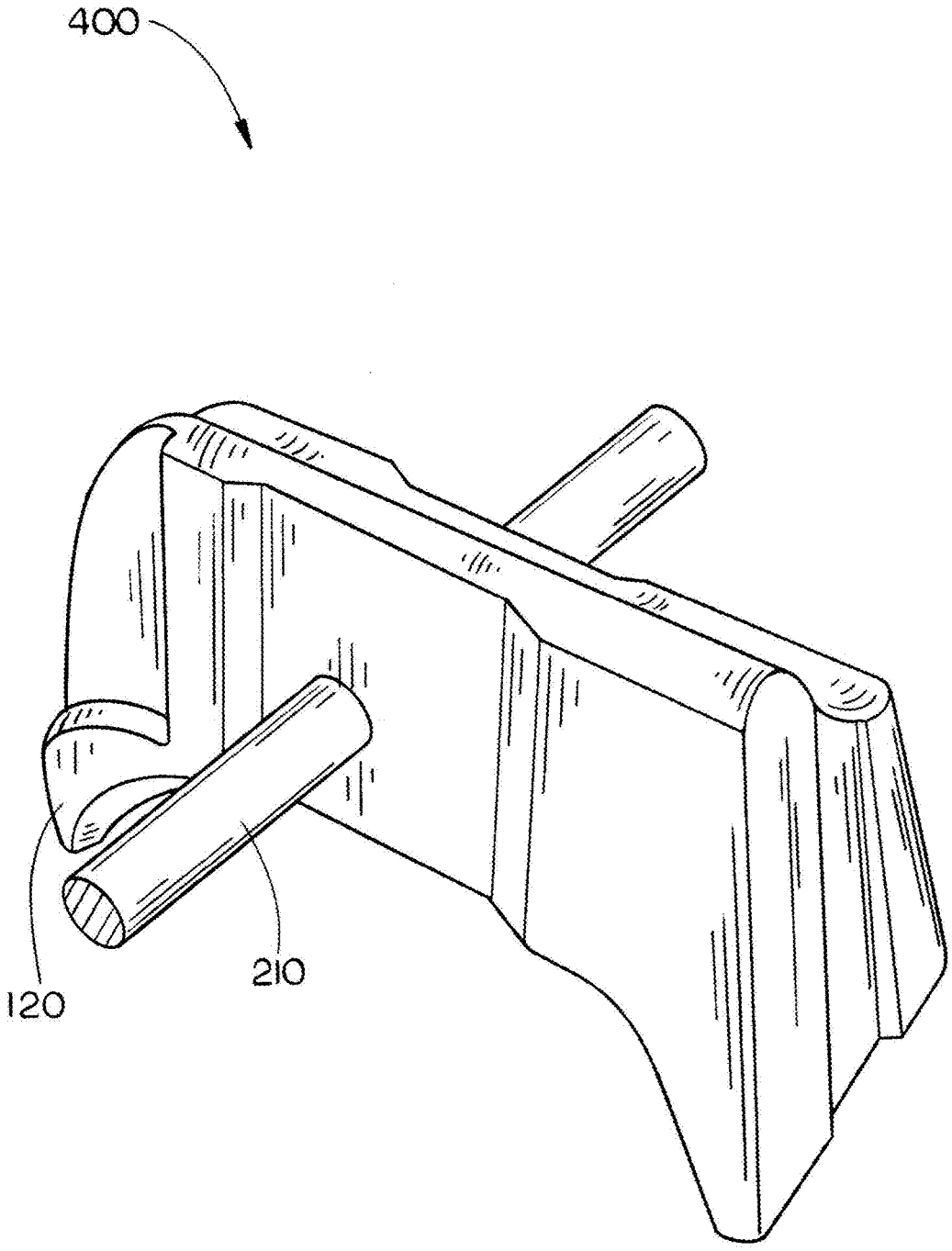
FIG. 4B is a perspective view of a follower with a compression tool engaged in accordance with an embodiment of the present invention.

Referring to FIG. 4B, a perspective view of a follower with a compression tool engaged in accordance with an embodiment of the present invention is shown. Follower 120 may have one or more protuberances as a compression tool 210 extending laterally from the follower through opposite lateral channel 112 enabling a user to engage the protuberances with fingers to place pressure on the follower 120 and compress the spring 122, remove spring tension on the last round loaded.

Alternately, protuberances used as a compression tool 210 may extend longitudinally forward and aft from follower through aligned opposite longitudinal channels in magazine body 110.

Additionally, follower 120 may incorporate a follower for reducing force on the spring for ease of loading an additional round. For example, follower may be constructed with a compression tool 210 as a semi-permanent rod protruding an optimal distance from the sides of the housing for users fingers to engage the rod yet a short enough distance to not encumber the user during magazine loading and shooting operation.

Figure 4C:
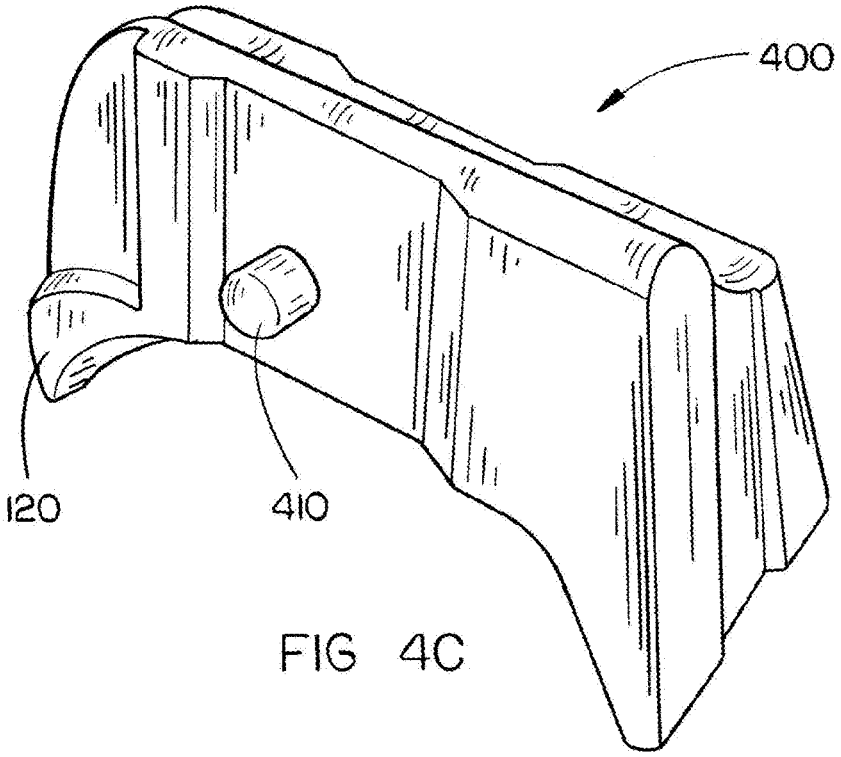
FIGS. 4C, 4D and 4E are a perspective view of a follower device with a permanently coupled compression tool in accordance with an embodiment of the present invention.
Figure 4D:
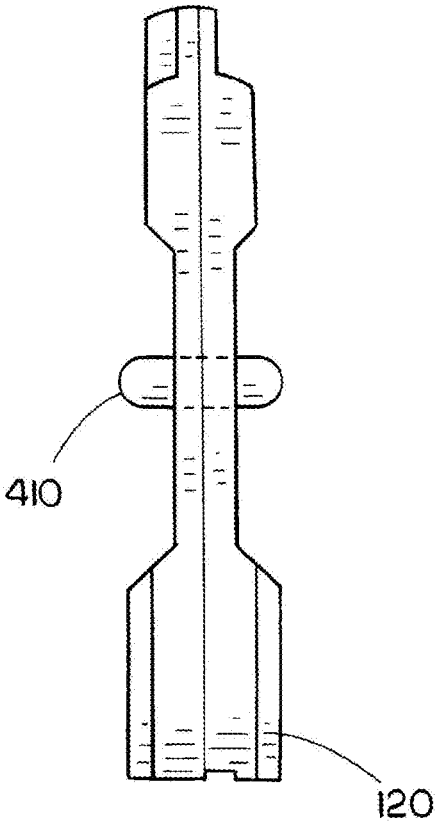
Figure 4E:
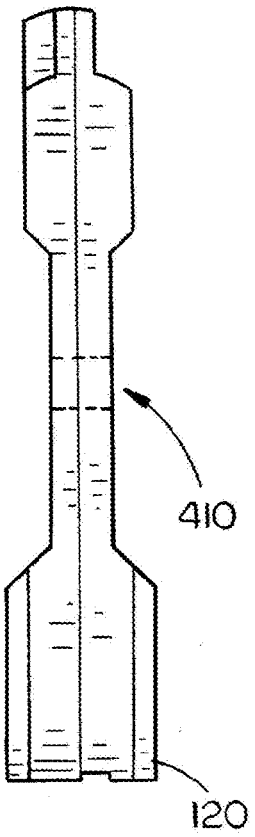

Referring to FIGS. 4C, 4D and 4E, a perspective view of a follower device with a permanently coupled compression tool in accordance with an embodiment of the present invention is shown. An additional embodiment of compression tool 210 may be configured as a laterally compressible compression tool 410 coupled to or an integral part of follower 120. A laterally compressible compression tool 410 may function to laterally compress (FIG. 4E) to a lateral distance equal to the width of follower 120 as lateral side pressure is placed on laterally compressible compression tool 410. For example, as follower is proximal with the magazine top 116, there are no opposite lateral channels 112 available into which laterally compressible compression tool 410 may expand. As follower 112 is displaced away from magazine opening 116 (rounds are loaded), the laterally compressible compression tool 410 may align with top 314 of opposite lateral channels 112 allowing the laterally compressible compression tool 410 to expand into the opposite lateral channels 112 to an operable position (FIG. 4D). A user may then use finger pressure to compress spring 122 by pressuring laterally compressible compression tool 410 toward floor plate 114.

Further, as magazine is fully loaded, laterally compressible compression tool 410 is proximal to the floor plate and in the operable position (expanded). As the magazine 300 is loaded into the weapon housing, the weapon housing may pressure laterally compressible compression tool 410 to a compressed position of a distance equal to the width of the magazine body 110. As rounds are expended, follower 120 with laterally compressible compression tool 410 attached, positions proximal to magazine top and laterally compressible compression tool 410 compresses further to the internal width of the magazine body 110 allowing follower 120 to travel to the empty position closest to the magazine top 116.

Figure 5:
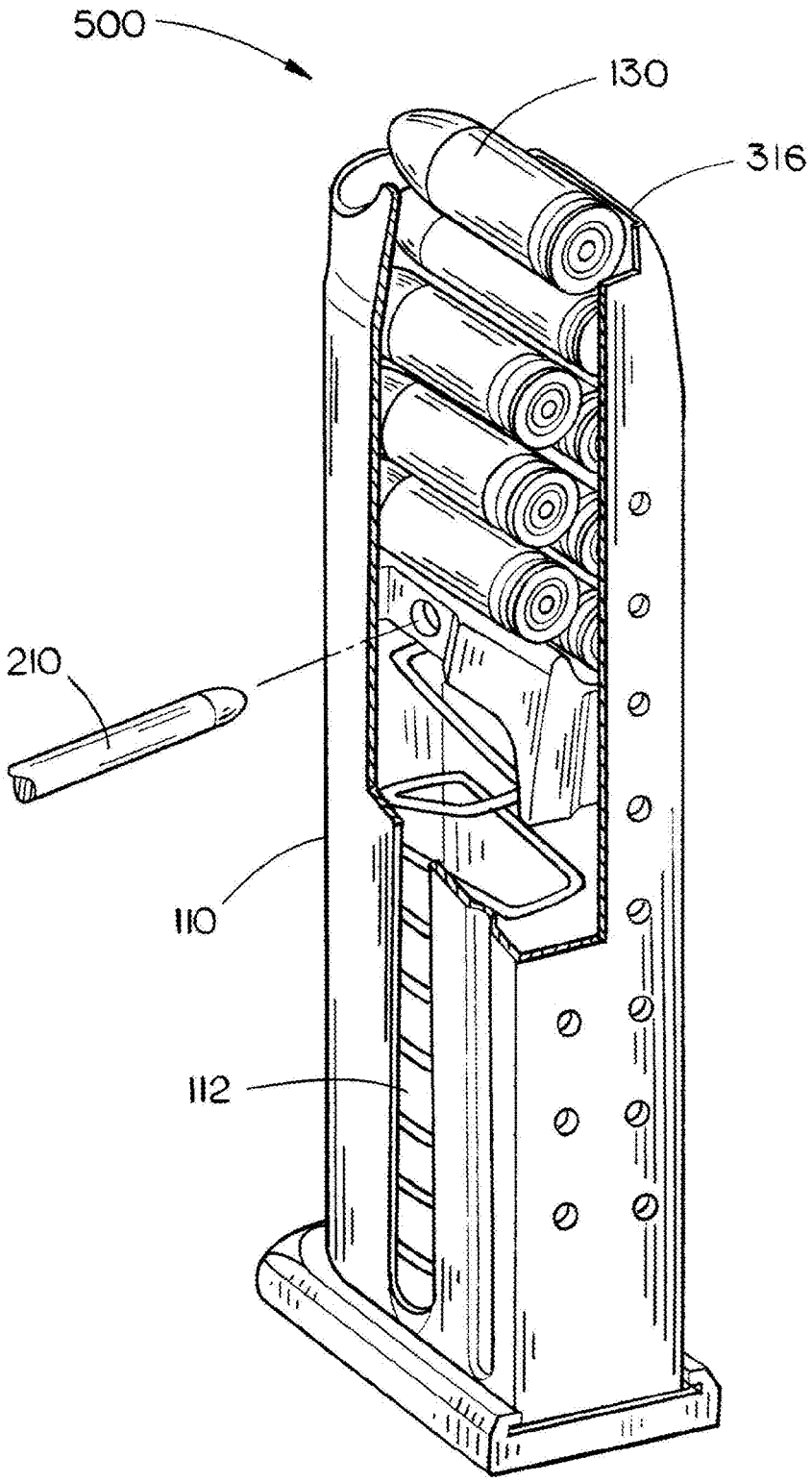
FIG. 5 is a cutaway view of a preferred embodiment of the present invention with eight rounds of ammunition loaded.

Referring to FIG. 5, a cutaway view of a preferred embodiment of the present invention with eight rounds of ammunition loaded is shown. Compression tool 210 may be threaded through both left and right opposite lateral channels 112 and engage and be threaded through follower sleeve 320. As the last round loaded is in position at the top 116 of the magazine body 110, a user may place pressure on compression tool 210 to force the spring 122 to compress. The compression relieves tension between the last round loaded and the retainer lips allowing for more easily loading an additional round 130. Should the spring 122 not be compressed, a full amount of spring force will be focused between the last round loaded and the retainer lips 316 of magazine top 116 causing a difficult operation for the user to load the next round.

In operation, a user may load a first round or rounds of ammunition 130 into the magazine body 110 through magazine top 116. As the user loads more rounds 130 into the magazine 100, the follower 120 may become visible between the opposite lateral channels 112. Preferably, the follower 120 and follower sleeve 320 may become visible after approximately seven rounds of ammunition are loaded.

As the compression tool 210 is inserted into the left of the opposite lateral channel 112, through the follower sleeve 320 in the follower 120, and through the right of the opposite lateral channel 112, the device 500 is prepared for further loading. A user may pressure the compression tool 210 in a direction away from the magazine opening 116 in order to relieve a portion of spring 122 pressure between the retainer lips 316 of the magazine and the last round loaded.

Length 312 to 314 of the opposite lateral channel 112 may preferably vary depending on at least the size of the magazine and the strength of the spring. For example, a higher compression spring 122 may require longer opposite lateral channels 112 to enable earlier access to follower sleeve 210. A larger magazine body 110 may require a shorter opposite lateral channels 112 since the spring force may be of lesser strength during initial loading and follower sleeve 210 access may not be required until later in the loading process. Optimal configurations may lead to variable length and width of opposite lateral channel 112 and similarly, to the optimal size of follower sleeve 320.

It is further contemplated, opposite lateral channels 112 may function in alternate positions of the magazine body 110. For example, in order to relieve spring 122 tension on the last round loaded, opposite lateral channels 112 may be incorporated into the front and rear of the magazine with follower sleeve similarly aligned longitudinally through the follower.

In addition, with the goal of preventing debris and other foreign objects from entering the internal magazine body 110, embodiments of the present invention may incorporate a shield to flexibly cover opposite lateral channels 112. It is contemplated, such shield may function with overlapping rubber, a brush type with overlapping bristles, and the like to protect the inside of magazine body 110 from foreign objects entering therein. The shield may provide function to prevent foreign objects from entering magazine body 110 while flexibly permitting compression tool 210 to enter opposite lateral channels 112 as well as travel the length of opposite lateral channels 112.

Embodiments of the present invention may incorporate such a shield capable of protecting common foreign object found in operational environments. For example, an operator may insert compression tool 210 through shield, through opposite lateral channels 112 and through follower sleeve 320 enabling the operator to load the magazine. Once the operator removes compression tool 210 from the magazine, shield may overlappingly close keeping foreign objects from entering magazine body 110.

Figure 6:
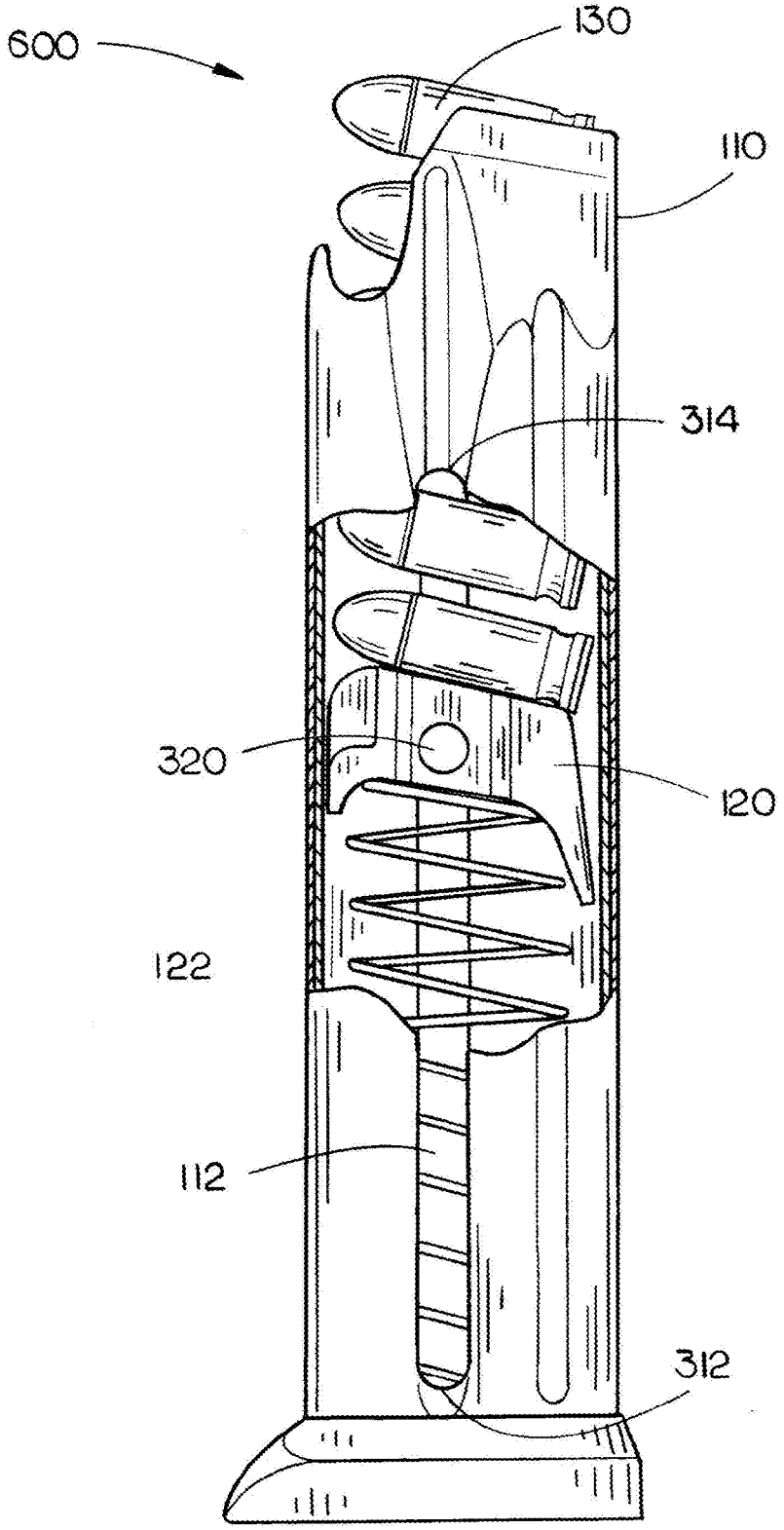
FIG. 6 is a side cutaway view of a preferred embodiment of the present invention.

Referring to FIG. 6, a side cutaway view of a preferred embodiment of the present invention is shown. Follower sleeve 320 may be aligned with aligned opposite lateral channels 112 creating a channel through which compression tool 210 may be slidably engaged. As the last round loaded is in the first position proximal to the magazine top 116, all of the pressure is on a surface area between the last round loaded and the two retainer lips 316 of the magazine. Without assistance, a user must overcome the spring tension in order to load an additional round. As the rounds are loaded, each successive round may be more difficult to load as the spring tension increases with displacement.

The compression tool 210 may also be of variable construction and size. For example, a well-known small shirt-pocket screwdriver may act as an appropriate tool to function as the compression tool 210. Alternatively a pen or pencil may be of sufficient strength to overcome the spring pressure and allow for efficient loading. Additionally, a high strength needle or small diameter wire, flexible cable, thread, or other material capable of overcoming the spring tension and relieving pressure on the last round loaded may function within the scope of the present invention.

It is contemplated, opposite lateral channels 112 may be of narrow construction capable of receiving a similarly narrow elongated tool for spring 122 pressure relief. Disclosed above is a follower sleeve of circular geometry. However, further contemplated herein a follower sleeve of alternate geometry may function within the scope of the present invention. For example, a rectangular follower sleeve may allow for greater material surrounding follower sleeve increasing the overall strength of the follower. Also a rectangular follower sleeve may allow for a narrower opposite lateral channel 112 leading to increased strength of the follower housing.

It is further contemplated, additional type and sizes of magazines may be manufactured within the scope of the present invention. Current FIGS. 1-6 may indicate a handgun magazine in a preferred embodiment, however the present invention may directly apply to a rifle sized magazine as well as any spring powered magazine required to be loaded by hand. Especially suited for the present invention may be curved magazines configured to hold in excess of 20 rounds. For example, a tactical rifle (M-16, AR-15, M4) may be able to receive a magazine which holds 100 rounds or more. Embodiments described herein may be directly applicable to construction of a 100 round magazine.

In addition, embodiments of the present invention may be configured to comply with a U.S. National and an international standard delineating magazine size, shape and construction. These standard magazines may be suited for loading into weapons based on such a standard. For example, a North Atlantic Treaty Organization (NATO) standard such as Standardization Agreement (STANAG) 4179 may indicate a size and shape of a magazine capable of loading in specific weapons. A U.S. Military Specification (e.g. MIL-STD, MIL-SPEC) may be one Specification within which embodiments of the present invention maintain compliance.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory.

CONCLUSION

Specific blocks, sections, devices, functions, processes and modules may have been set forth. However, a skilled technologist will realize that there are many ways to partition the system, and that there are many parts, components, processes, modules or functions that may be substituted for those listed above.

While the above detailed description has shown, described and pointed out the fundamental novel features of the invention as applied to various embodiments, it will be understood that various omissions and substitutions and changes in the form and details of the system illustrated may be made by those skilled in the art, without departing from the intent of the invention. The foregoing description details certain embodiments of the invention. It will be appreciated, however, that no matter how detailed the foregoing appears, the invention may be embodied in other specific forms without departing from its spirit or essential characteristics. The described embodiment is to be considered in all respects only as illustrative and not restrictive and the scope of the invention is, therefore, indicated by the appended claims rather than by the foregoing description. All changes which come within the meaning and range of equivalency of the claims are to be embraced within their scope.

Those having skill in the art will recognize that the state of the art has progressed to the point where there is little distinction left between hardware, software, and/or firmware implementations of aspects of systems; the use of hardware, software, and/or firmware is generally (but not always, in that in certain contexts the choice between hardware and software can become significant) a design choice representing cost vs. efficiency tradeoffs. Those having skill in the art will appreciate that there are various vehicles by which processes and/or systems and/or other technologies described herein can be effected (e.g., hardware, software, and/or firmware), and that the preferred vehicle will vary with the context in which the processes and/or systems and/or other technologies are deployed. For example, if an implementer determines that speed and accuracy are paramount, the implementer may opt for a mainly hardware and/or firmware vehicle; alternatively, if flexibility is paramount, the implementer may opt for a mainly software implementation; or, yet again alternatively, the implementer may opt for some combination of hardware, software, and/or firmware. Hence, there are several possible vehicles by which the processes and/or devices and/or other technologies described herein may be effected, none of which is inherently superior to the other in that any vehicle to be utilized is a choice dependent upon the context in which the vehicle will be deployed and the specific concerns (e.g., speed, flexibility, or predictability) of the implementer, any of which may vary. Those skilled in the art will recognize that optical aspects of implementations will typically employ optically-oriented hardware, software, and or firmware.

One skilled in the art will recognize that the herein described components (e.g., operations), devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components (e.g., operations), devices, and objects should not be taken limiting.

Although a user is shown/described herein as a single illustrated figure, those skilled in the art will appreciate that the user may be representative of a human user, a robotic user (e.g., computational entity), and/or substantially any combination thereof (e.g., a user may be assisted by one or more robotic agents) unless context dictates otherwise. Those skilled in the art will appreciate that, in general, the same may be said of "sender" and/or other entity-oriented terms as such terms are used herein unless context dictates otherwise.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

The herein described subject matter sometimes illustrates different components contained within, or connected with, different other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components, and/or wirelessly interactable, and/or wirelessly interacting components, and/or logically interacting, and/or logically interactable components.

In some instances, one or more components may be referred to herein as "configured to," "configurable to," "operable/operative to," "adapted/adaptable," "able to," "conformable/conformed to," etc. Those skilled in the art will recognize that such terms (e.g., "configured to") can generally encompass active-state components and/or inactive-state components and/or standby-state components, unless context requires otherwise.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B.

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

What is claimed is:

1. A device for efficient loading of a spring powered magazine, comprising:

a magazine, the magazine for receiving and storing a plurality of rounds of ammunition, the magazine having a magazine body, the magazine body having a floor, two opposite sides, and a top opposite the floor;

a floor plate removably attached to the magazine floor, the floor plate for securing the floor of the magazine;

a spring within the magazine body for applying spring tension vertically from the floor plate, the floor plate removably coupled to a floor end of the spring;

a follower within the magazine, the follower for slidably transferring the spring tension from the spring to the plurality of rounds of ammunition, the follower removably coupled to a top end of the spring, the floor plate removably coupled to a bottom end of the spring;

the magazine body configured with opposite lateral channels in the two opposite sides, the opposite lateral channels of equal dimension and having a bottom end proximal to the magazine floor and a top end distal from the magazine floor; the opposite lateral channels having a maximum longitudinal dimension of approximately 0.15 of a magazine body longitudinal dimension, the opposite lateral channels having a minimum vertical dimension of approximately 0.6 of a magazine body vertical dimension, the opposite lateral channels located approximately at a longitudinal midpoint of the magazine body;

the follower having a follower sleeve, the follower sleeve having a longitudinal dimension approximately equal to the longitudinal dimension of the opposite lateral channels, the follower sleeve aligned with the opposite lateral channels as the follower slidably travels along a vertical axis of the magazine body;

wherein the follower sleeve is configured to be directly and removably engaged by a compression tool receiving pressure at both sides of the two opposite sides of the magazine, the follower sleeve further configured to relieve spring tension away from the plurality of rounds of ammunition as the compression tool acts upon the follower.

2. The device for efficient loading of a spring powered magazine of claim 1, wherein the bottom ends of the opposite lateral channels are proximal to the floor of the magazine body and the top ends of the opposite lateral channels are positioned so the follower sleeve is visible after approximately seven rounds of ammunition are loaded in the magazine body.

3. The device for efficient loading of a spring powered magazine of claim 1, wherein the follower sleeve is cylindrical with a diameter approximately equal to the longitudinal dimension of the opposite lateral channels, the compression tool configured as any tool of appropriate size and strength to be threaded through the follower sleeve and receive pressure at both sides of the magazine and including at least one of a rod of a diameter slightly smaller than the diameter of the follower sleeve, a high strength needle or small diameter wire, flexible cable, thread, or a pocket screwdriver.

4. The device for efficient loading of a spring powered magazine of claim 1, wherein the follower sleeve diameter is approximately equal to the longitudinal dimension of the opposite lateral channels and is approximately 0.1 inches in diameter.

5. The device for efficient loading of a spring powered magazine of claim 1, wherein the opposite lateral channels in the two opposite sides of the magazine body incorporate a shield to prevent foreign objects from entering the magazine body through the lateral channels.

6. The device for efficient loading of a spring powered magazine of claim 1, wherein the magazine body is configured with opposite longitudinal channels, the opposite longitudinal channels configured on longitudinal sides of the magazine body, the follower sleeve configured longitudinally through follower and aligned with the opposite longitudinal channels.

7. The device for efficient loading of a spring powered magazine of claim 1, wherein the compression tool is permanently coupled to the follower, the coupled compression tool further configured to laterally compress to a dimension equal to an internal dimension of the magazine body, the coupled compression tool further configured to laterally extend to a lateral dimension greater than an external dimension of the magazine body.

8. A method for efficient loading of a spring powered magazine, comprising:

configuring a magazine body with two opposite sides with opposite lateral channels, the magazine body one element of a magazine for receiving and storing a plurality of rounds of ammunition, the magazine having a floor and a top opposite the floor, the opposite lateral channels of equal dimension and having a bottom end proximal to the magazine floor and a top end distal from the magazine floor; the opposite lateral channels having a maximum longitudinal dimension of approximately 0.15 of a magazine body longitudinal dimension, the opposite lateral channels having a minimum vertical dimension of approximately 0.6 of a magazine body vertical dimension, the opposite lateral channels located approximately at a longitudinal midpoint of the magazine body;

configuring a follower with a follower sleeve, the follower one element of the magazine and within the magazine body, the follower for slidably transferring a spring tension from a spring to the plurality of rounds of ammunition, the follower removably coupled to a top end of the spring, the follower sleeve having a longitudinal dimension approximately equal to the longitudinal dimension of the opposite lateral channels, the follower sleeve aligned with the opposite lateral channels as the follower slidably travels along a vertical axis of the magazine body;

removably coupling the spring within the magazine body to a floor plate on a floor end of the spring and to the follower on a top end of the spring for applying spring tension vertically from the spring;

aligning the opposite lateral channels with the follower sleeve, the aligning for inserting a compression tool through the opposite lateral channels and the follower sleeve to relieve the spring tension away from the plurality of rounds of ammunition as pressure is applied at both sides of the two opposite sides of the magazine body and as the compression tool acts upon the follower.

9. The method for efficient loading of a spring powered magazine of claim 8, wherein the bottom ends of the opposite lateral channels are proximal to the floor of the magazine body and the top ends of the opposite lateral channels are positioned so the follower sleeve is visible after approximately seven rounds of ammunition are loaded in the magazine body.

10. The method for efficient loading of a spring powered magazine of claim 8, wherein the follower sleeve is cylindrical with a diameter approximately equal to the longitudinal dimension of the opposite lateral channels, the compression tool configured as any tool of appropriate size and strength to be threaded through the follower sleeve and receive pressure at both sides of the magazine body and including at least one of a rod of a diameter slightly smaller than the diameter of the follower sleeve, a high strength needle, a small diameter wire, a flexible cable, a thread, or a pocket screwdriver.

11. The method for efficient loading of a spring powered magazine of claim 8, wherein the follower sleeve diameter is approximately equal to the longitudinal dimension of the opposite lateral channels and is approximately 0.1 inches in diameter.

12. The method for efficient loading of a spring powered magazine of claim 8, wherein the follower is further configured with a permanently affixed compression tool, the permanently affixed compression tool extends laterally from the opposite lateral channels a distance allowing the magazine to be inserted into a weapon housing, and wherein the top end of the opposite lateral channels extends vertically proximal to the top of the magazine body.

13. The method for efficient loading of a spring powered magazine of claim 8, wherein the magazine body is configured with opposite longitudinal channels, the opposite longitudinal channels configured on longitudinal sides of the magazine body, the follower sleeve configured longitudinally through follower and aligned with the opposite longitudinal channels.

14. The method for efficient loading of a spring powered magazine of claim 8, wherein the compression tool is permanently coupled to the follower, the coupled compression tool further configured to laterally compress to a dimension equal to an internal dimension of the magazine body, the coupled compression tool further configured to laterally extend to a lateral dimension greater than an external dimension of the magazine body.

15. A follower comprising:

a follower body positioned within a magazine to slidably transfer spring tension from a spring to a plurality of rounds of ammunition, the follower body coupled to a top end of the spring, the bottom end of the spring coupled to a floor plate of the magazine, the follower body comprising two opposite sides, a top portion for engaging a plurality of rounds of ammunition, and a follower sleeve, wherein, the two opposite sides of the follower body are in slidable communication with two opposing sides of a magazine body, each side of the two opposing sides of the magazine body are configured with lateral channels, the lateral channels of the magazine body of equal dimension and having a bottom end proximal to the floor plate of the magazine and a top end distal from the floor plate of the magazine, wherein, the two opposing sides of the magazine body configured with lateral channels are reinforced to maintain structural integrity of the magazine body, and the lateral channels are located approximately at a longitudinal midpoint of the magazine body and aligned with the follower sleeve to enable the follower sleeve to receive a compression tool through the lateral channels and the follower sleeve, wherein, the follower sleeve has a longitudinal dimension approximately equal to the longitudinal dimension of the opposite lateral channels and is configured to be directly and removably engaged by the compression tool at both of the two opposite sides of the follower body to relieve a tension of the spring and allow the follower to slidably move away from an opening in the magazine body as the compression tool acts upon the follower via the follower sleeve, and wherein the opening in the magazine body is configured to receive the plurality of rounds of ammunition.

* * * * *